US005404948A

United States Patent [19]

Fletcher

[11] Patent Number: 5,404,948

[45] Date of Patent: Apr. 11, 1995

[54] INJECTION WELL FLOW MEASUREMENT

[75] Inventor: Paul A. Fletcher, Richardson, Tex.

[73] Assignee: Atlantic Richfield Company, Los Angeles, Calif.

[21] Appl. No.: 226,123

[22] Filed: Apr. 11, 1994

[51] Int. Cl.[6] ..... E21R 47/00

[52] U.S. Cl. ..... 166/250; 166/65.1; 166/115

[58] Field of Search ..... 166/250, 241.5, 269, 166/264, 65.1, 115

[56] References Cited

U.S. PATENT DOCUMENTS

| | | | |
|---|---|---|---|
| 4,274,486 | 6/1981 | Fredd | 166/250 |
| 4,770,243 | 9/1988 | Fouillout et al. | 166/250 X |
| 4,928,759 | 5/1990 | Siegfried, II et al. | 166/65.1 |
| 5,018,574 | 5/1991 | Smith | 166/185 |
| 5,094,103 | 3/1992 | Wicks, III et al. | 166/250 X |
| 5,095,983 | 3/1992 | Magnani | 166/250 |
| 5,337,821 | 8/1994 | Peterson | 166/250 |

*Primary Examiner*—Ramon S. Britts
*Assistant Examiner*—Frank S. Tsay
*Attorney, Agent, or Firm*—Michael E. Martin

[57] ABSTRACT

Injection well fluid flow is measured by a device which has a running head and a body with a turbine type flowmeter interposed therein between the running head and discharge port means in the body. The running head may be interchangeable for positioning the body in selected positions in a tubing string in sealing engagement with a seating surface in the tubing string whereby fluid flow entering selected zones in communication with the injection well may be directly measured. The flow measuring device may include a signal storage or memory circuit disposed thereon for receiving and storing signals from the flowmeter.

7 Claims, 1 Drawing Sheet

INJECTION WELL FLOW MEASUREMENT

BACKGROUND OF THE INVENTION

1. Field of the Invention

The present invention pertains to a device and method for measuring fluid flow into plural selected zones of an earth formation from an injection well whereby accurate measurement of the flow into each of the zones may be measured.

2. Background

In water and gas injection wells, it is common to inject such fluids into multiple, spaced apart earth formation zones simultaneously. However, in order to manage the production of fluids from a particular reservoir or the disposition of the injection fluids into selected earth formation zones, it is desirable to know the flow rate of fluid into each of the zones independently. Common practice in making this determination comprises lowering a tool into a well on an electric signal conducting cable or so-called E-line which tool has a small spinner or propeller type metering device mounted thereon and which is somewhat less than the diameter of the tubing through which the fluid to be measured is flowing. Accordingly, the accuracy of these so-called spinner type surveys is insufficient to effectively manage injection processes or to comply with certain regulatory requirements. Moreover, prior art measuring devices of the type mentioned above require relatively complicated and expensive support equipment and substantially continuous monitoring by operating personnel.

U.S. Pat. No. 4,928,759 to Siegfried et al and U.S. Pat. No. 5,018,574 to L. J. Smith, both assigned to the assignee of the present invention, describe devices adapted to measure fluid flow rates in production wells.

However, the present invention overcomes the deficiencies of prior art injection well flow measurement methods and devices as will be recognized by those skilled in the art from the following summarization and detailed description.

SUMMARY OF THE INVENTION

The present invention provides an improved device for accurately measuring injection well fluid flow, including water and other liquids or certain gases, for example. In accordance with an important aspect of the present invention, a device is provided which may be lowered into a well tubing string on a so-called slickline or similar cable which does not require to be capable of conducting an electric signal and which is configured such that all of the flow through the tubing string at the point of disposition of the device flows through the device and the flow rate is accurately measured by the device. By positioning the device in selected positions in a well tubing string and sealing off any flow which would attempt to bypass the device, the flow rate of fluid into each of plural injection zones may be accurately determined.

In accordance with another important aspect of the present invention, a unique flow measurement device is provided for insertion in a fluid injection well, which device is adapted to be seated in a selected position in a well tubing string to require that all of the fluid flowing through the tubing string passes through the device and the device may be left in a selected working position for extended periods of time without constant monitoring by operating personnel. The flow measurement device preferably includes a head member which is adapted to be seated in a cooperating seat portion of the tubing string, a turbine type flowmeter interposed in a body extending from the head member and an onboard memory circuit for recording the flow rates measured by the flowmeter. The body which supports the flowmeter and the memory circuit is provided with suitable ports or passages for discharging the fluid flowing through the device back into the tubing string for flow through the wellbore and into the selected earth formation zone.

Those skilled in the art will recognize certain advantages and unique features of the invention from the foregoing as well as from reading the detailed description which follows in conjunction with the drawing.

DESCRIPTION OF A PREFERRED EMBODIMENT

Figure 1:
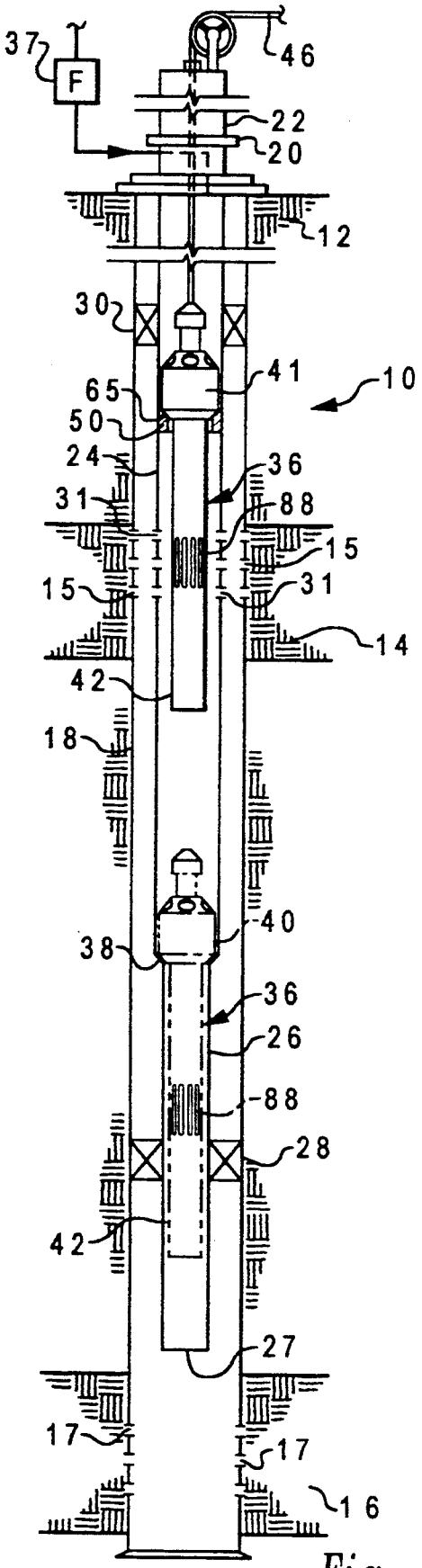
FIG. 1 is a schematic diagram of a fluid injection well showing an improved injection fluid flow measurement device in accordance with the invention disposed in selected positions.

In the description which follows, like parts are marked throughout the specification and drawing with the same reference numerals, respectively. The drawing figures are not necessarily to scale in the interest of clarity and conciseness.

Referring to FIG. 1, there is illustrated a well 10 which extends into an earth formation 12 including multiple spaced apart zones 14 and 16, for example. The well 10 is provided with a suitable casing 18 extending within the earth formation 12 through both zones 14 and 16 and provided with suitable perforations 15 and 17 for injecting fluids such as gas or water into the zones 14 and 16, respectively. The casing 18 extends to a conventional wellhead 20 at the earth's surface and a suitable wireline lubricator device 22 is also provided at the wellhead 20 for a purpose to be described in further detail herein.

The well 10 is exemplary in that two spaced apart fluid injection zones are illustrated. Those skilled in the art will recognize that three or more spaced apart zones may be subjected to fluid injection for storage of fluid in the earth, stimulating the production of other fluids present in the formation zones into which the injection is taking place or for the disposal of certain materials. A particularly useful application for the present invention is for injection well flow measurement of water injection wells in water flooding operations to stimulate the production of hydrocarbon fluids from multiple spaced apart zones into which the injection well penetrates.

The well 10 also includes a suitable tubing string extending from the wellhead 20 and generally designated by the numeral 24. The tubing string 24 has a reduced diameter portion 26 extending below a packer 28. A second packer 30 is interposed in the well casing 18 between the first packer 28 and the wellhead 20. The packers 28 and 30 are positioned to isolate the fluid flowing into the injection zone 14 from that flowing into the injection zone 16 and, of course, from a third or fourth injection zone, not shown, or the wellhead 20. In the arrangement illustrated in FIG. 1, the tubing string 26 has a lower distal end 27 which terminates above the perforations 17. Suitable ports 31 are formed in the tubing string 24 adjacent to the casing perforations 15 for conducting injection fluid from the tubing string into the injection zone 14.

During normal operation of the injection well 10 water, for example, is injected into the tubing string 24 by suitable means, not shown, at the wellhead 20 and flows down through the tubing string 24, 26 exiting the ports 31 and the distal end 27 to flow into the zones 14 and 16. It is desirable to know the volumetric flow rate of fluid flowing out of the ports 31 and into the zone 14, as well as out of the tubing distal end 27 and into the zone 16, respectively, so as to be able to adjust the injection rates to modify the water flooding or injection process and also to comply with certain regulatory requirements, depending on the location of the well. Accordingly, it is important to know the injection rate of water flowing through the perforations 17 as well as through the perforations 15. The prior art methods discussed hereinabove do not accurately measure the respective flow rates.

However, the present invention contemplates the provision of a flow measuring device, generally designated by the numeral 36 which is shown interposed in the tubing string 24 in a first position as well as alternate position wherein the device extends within the reduced diameter tubing string section 26. In the alternate position shown in FIG. 1 for the device 36, the device is lodged in a so called no go profile 38 interposed between the tubing string sections 24 and 26 whereby a running head member 40 for the device 36 is shown engaged with the no go profile 38 and a main body 42 of the device extends within the tubing string section 26. In this position of the flow measuring device 36, that portion of the flow which is flowing into the formation zone 16 may be measured since all of the flow will be required to flow through the device as will be explained in further detail herein.

Accordingly, the device 36 may be lowered into the well 10 within the tubing string 24, 26 by suitable means such as a conventional slickline or similar cable 46, for example, until the running head 40 engages the no go profile 38 whereby the device may then be operated to measure the amount of water or other fluid being injected through the tubing string 24, 26 which is entering the formation zone 16. Upon retrieval of the device 36 from the well 10, the running head 40 may be replaced by a larger diameter running head 41, FIG. 1, which, upon reinsertion of the device 36 into the tubing string 24 will register with a no go profile 50, to position the device 36 in the position illustrated in FIG. 1 wherein it is adjacent to the formation zone 14 and whereby the total flow of fluid flowing through the tubing string 24 at the no go profile 50 may be measured. Accordingly, upon measurement of the flow rate through the device 36 in the position shown in FIG. 1, adjacent the zone 14, the flow rate through the device previously measured, when it is in the alternate position shown in FIG. 1, may be subtracted from the second mentioned flow measurement to obtain the amount of fluid that may be flowing into the formation zone 14. This procedure would be repeated if more than the two zones 14 and 16, shown in the drawing, were being flooded with fluid from the well 10. If only the two zones 14 and 16 were being flooded, then measurement using the device in the position shown in registration with the no go profile 38 would be sufficient to determine flow rates into both the zones 14 and 16 since total flow being injected at the wellhead 20 into the tubing string 24, 26 could be suitably measured at the surface by a flowmeter 37, for example. Alternatively, if the flowmeter 37 is not present, flow into both zones 14 and 16 can be determined by making measurements at both positions of the device 36 as described.

Figure 2:
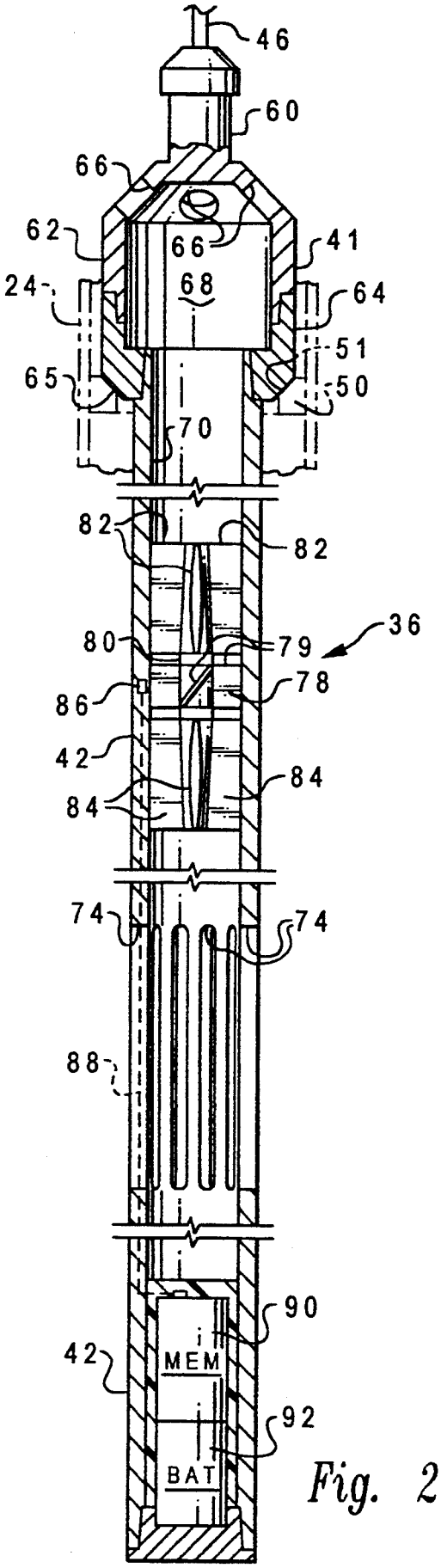
FIG. 2 is a longitudinal central section view of a preferred embodiment of the flow measurement device of the invention.

Referring now to FIG. 2, certain details of the device 36 are illustrated. The running head 41 is illustrated by way of example and is characterized by a conventional fishing neck 60 formed as an integral part of a first body part 62 of the running head 41 which is suitably connected to a second body part 64 of the running head. The fishing neck 60 is also adapted to provide for suitably connecting the running head 41 to the slickline 46 in a conventional manner, not shown. Alternatively, the device 36 may be conveyed into the well 10 on a suitable tubing, not shown.

Plural fluid entry ports 66 are formed in the body part 62 and open into a cavity 68 which is in communication with a central longitudinal bore 70 of the body 42 forming a flow passage for fluid flowing through the tubing string 24, 26 when the running head 41, for example, is in registration with the no go profile 50. In this regard, a suitable seating surface 65 is formed on the running head 41 for substantially fluid tight engagement with a surface 51 defining the profile 50, as shown in FIG. 2.

The body part 42 of the device 36 is characterized as a substantially elongated cylindrical tubular member having the central bore 70 formed therein and a plurality of elongated slot-like ports 74 which open to the exterior of the body part for conducting fluid flow which has entered the device 36 through the ports 66, the cavity 68 and the bore 70 whereby substantially all of the flow passing through the tubing string at the position of the profile 50 is required to flow through the device 36. Suitable flow measuring means is provided in the device 36, as shown by way of example, comprising a turbine type flowmeter having a rotary turbine wheel 78 suitably mounted on a support shaft 80 disposed in the bore 70. The shaft 80 is suitably supported by respective sets of circumferentially spaced flow straightening vanes 82 and.84, for example. The turbine wheel 78 has plural radially extending turbine blades 79 which, when rotating past a sensor 86, are operable to send a suitable electrical signal from the sensor through conductor means 88 to a signal storage or memory circuit 90 disposed in the body 42 near the lower distal end thereof. The circuit 90 is adapted to receive operating power from a suitable battery 92 also disposed in the body 42. With this arrangement in the device 36 it may be disposed in a working position in the well 10 for an extended period of time without constant or even periodic attention by operating personnel. On retrieval of the device 36 to the surface, the memory circuit 90 may be connected to a suitable data receiving device, not shown, such as a digital computer for receiving information regarding the output signal of the flowmeter characterized by the aforementioned turbine wheel 78 and respective sets of flow straightening vanes 82 and 84.

Those skilled in the art will recognize that other types of flowmeters may be substituted for the turbine type meter described in detail hereinabove although the turbine type meter is advantageous in that it has a high accuracy, may be installed in a relatively small diameter tube or body such as the body 42 and does not create a substantial pressure drop due to friction flow losses of fluid flowing through the meter. The configuration of the flowmeter turbine wheel 78, for example, may be interchanged with a suitable wheel for measurement of the fluid being pumped through the tubing string 24 whether it be a liquid or a gas. The turbine wheel 78 and the associated flow straightening vanes 82 and 84 are preferably located a suitable distance from the cavity or passage 68 as well as from the exit ports 88 so that flow entering and leaving the turbine wheel will not be turbulent or of such a nature as to interfere with the accuracy of the meter.

Those skilled in the art will also recognize that the device 36 is unique in that it may inserted in a tubing string 24 and placed in registration with a so called landing or no go profile or other suitable seating surface so that the seating surface 65 of the running head 41 may substantially prevent the bypass of fluid around the device and through the tubing string. In this regard, all of the flow through the device is required to be measured by the turbine wheel 78 and, in the arrangement illustrated in FIG. 1 would comprise all of the flow passing the device at its point of location.

Moreover, certain modifications may be made to the device 36 without departing from the scope and spirit of the invention. For example, the turbine wheel 78 may be replaced by a suitable orifice with a differential pressure measurement means interposed in the body 42 and operable to measure differential pressures which may be recorded by the memory circuit 90 or the circuit may be adapted to calculate flow through such an orifice based on such differential pressure measurements. An orifice may, for example, be more suitable for measuring gas flow through the device 36 as compared with liquid flow. The running head 41 may include suitable mechanism to permit disconnection of the device 36 from the slickline 46 or a similar conveyance means once the device is in place and in registration with a no go profile such as the profile 38 or the profile 50, for example. The running head 40 is virtually identical to the running head 41 but is of sufficiently smaller diameter that it will pass through the no go profile 50 but not the no go profile 38. In other words, the running head 40 is registrable with the no go profile 38 in the same manner that the running head 41 is registrable with the no go profile 50 illustrated in FIGS. 1 and 2. The device 36 may be constructed using known materials for wellbore instruments and similar flow measurement devices.

The operation of the device 36 to make flow measurements into the formation zones 14 and 16 is believed to be understandable from the foregoing description. However, briefly, when it is desired to know the amount of injection water, for example, being injected into the well 10 and the respective formation zones 14 and 16, the device 36 would be inserted into the position shown by the alternate position lines in FIG. 1 using the running head 40 in registration with the no go profile 38. Although the ports 88 open into the interior of the tubing section 26, there is sufficient clearance to substantially provide unimpeded flow of liquid down through the tubing 24, through the device 36, out of the ports 88 and down through the tubing section 26 to exit the distal end 27 without effecting the normal fluid flow through this section of tubing when the device 36 is not present. With the device 36 in place in the alternate position shown in FIG. 1, normal injection fluid procedures may be carried out and the amount of fluid passing through the device and into the formation zone 16 may be easily measured, particularly upon retrieval of the device 36.

Upon placement of the device 36 in a working position the slickline 46 may be disconnected from the device, if desired, and reconnected when it is desired to retrieve the device to the surface. Alternatively, suitable means may be provided for conducting signals to the surface during operation of the device 36, such as substituting an E-line for slickline 46, assuming that the slickline is left connected to the device 36, or by other suitable means such as stress wave telemetry, electromagnetic telemetry and the like. The amount of flow being measured by the device 36 is subtracted from the amount of flow being measured by the flowmeter 37 whereby the amount of flow into the formation zone 14 may be determined as the difference between these two flow rates. If yet a third injection zone, not shown, is disposed above the zone 14 and is subject to receiving some of the liquid being pumped down through the tubing string 24, the device 36 may then be fitted with the running head 41 and reinserted in the well for registration with the no go profile 50 and flow at that point measured to determine how much of the total flow being measured by the meter 37 is entering the third zone, not shown.

Although a preferred embodiment of a flow measuring device and method in accordance with the invention have been described in some detail, those skilled in the art will recognize that various substitutions and modifications may be made to the device and method for measuring flow into multiple zones in an injection well without departing from the scope and spirit of the invention as recited in the appended claims.

What is claimed is:

1. An apparatus for use in an injection well for injecting fluid into selected ones of plural zones of an earth formation through a tubing string, said apparatus comprising:

a flow measuring device insertable in said tubing string and in registration with a seating surface in said tubing string to block the flow of fluid around said device and within said tubing string, said device comprising:

a running head part;

a body connected to said running head part;

passage means within said running head part and said body, respectively, for conducting substantially all fluid flow through said device; and flowmeter means within said body for measuring the flow rate of fluid passing through said device and into at least one of said zones.

2. The apparatus set forth in claim 1 wherein:

said device includes a memory circuit disposed in said body and in communication with said flowmeter means for receiving signals from said flowmeter means to record the flow rate of fluid passing through said flowmeter means.

3. The invention set forth in claim 1 wherein:

said device includes a turbine flowmeter including a rotary turbine wheel interposed in said body a predetermined distance from said running head part and from port means in said body for discharging flow from said device into said well.

4. The invention set forth in claim 3 wherein:

said port means are formed in said body between said turbine wheel and said memory circuit.

5. The invention set forth in claim 1 wherein:

said running head part includes a surface thereon registrable with a cooperating surface on said tubing string for positioning said device in said tubing string.

6. A method for measuring the rate of flow of fluid being injected into multiple zones of an earth formation through an injection well, said injection well having a tubing string disposed therein, said tubing string including at least one seating surface for receiving a flow measuring device insertable within said tubing string and port means in said tubing string for communicating fluid to at least one of said zones, said method comprising the steps of:

inserting said device into said tubing string and into registration with said seating surface whereby said device is interposed in said tubing string between a wellhead and the lowermost zone into which fluid is being injected;

measuring the flow rate of fluid passing through said device and into said lowermost zone;

positioning said device in said tubing string at a second position between said wellhead and said port means in said tubing string for communicating pressure fluid to another of said zones and measuring the flow of fluid passing through said device into said lowermost zone and said another zone, collectively; and determining the flow of fluid into said another zone by subtracting the flow of fluid measured by said device passing into said lowermost zone from the flow of fluid passing through said device in said second position in said tubing string.

7. A method for measuring the rate of flow of fluid being injected into a zone of an earth formation through an injection well, said injection well having a tubing string disposed therein, said method comprising the steps of:

inserting a flow measuring device into said tubing string and into registration with a seating surface in said tubing string whereby said device is interposed in said tubing string between a wellhead and said zone; and measuring the flow rate of fluid passing through said device and into said zone.

* * * * *